US007762406B2

(12) United States Patent
Qiang

(10) Patent No.: US 7,762,406 B2
(45) Date of Patent: Jul. 27, 2010

(54) FOLDING SHOE RACK

(75) Inventor: Lu Zhi Qiang, ShenZhen (CN)

(73) Assignee: Whitmor Manufacturing Co., Inc., South Haven, MS (US)

( * ) Notice: Subject to any disclaimer, the term of this patent is extended or adjusted under 35 U.S.C. 154(b) by 406 days.

(21) Appl. No.: 11/746,256

(22) Filed: May 9, 2007

(65) Prior Publication Data

US 2007/0284321 A1 Dec. 13, 2007

Related U.S. Application Data

(60) Provisional application No. 60/798,930, filed on May 9, 2006.

(51) Int. Cl.
*A47F 7/08* (2006.01)

(52) U.S. Cl. ..... 211/38; 211/34; 211/35; 211/195; 211/118; 403/161; 403/162

(58) Field of Classification Search ..... 211/34, 211/35, 36, 37, 38, 195, 189, 149, 186, 104, 211/118, 113; 403/161, 162, 326, 329
See application file for complete search history.

(56) References Cited

U.S. PATENT DOCUMENTS 298,104 A * 5/1884 Mackay ..... 403/162
2,048,380 A * 7/1936 Hansen ..... 16/387
2,294,504 A * 9/1942 Knape ..... 211/38
2,389,910 A 11/1945 Hoffman
2,695,106 A * 11/1954 Cohen ..... 211/38
2,832,943 A * 4/1958 Cutler ..... 439/357
2,901,117 A * 8/1959 Plocki et al. ..... 211/38
2,964,341 A * 12/1960 Doyle et al. ..... 403/162
3,184,273 A 5/1965 Blough
3,746,179 A 7/1973 Paumgardhen
3,783,995 A 1/1974 Tobin
3,907,118 A 9/1975 Pelavin
3,974,917 A * 8/1976 Waxmanski ..... 211/36
4,244,301 A 1/1981 Nakatsu
4,327,836 A 5/1982 Okuno
4,688,681 A * 8/1987 Bergeron ..... 211/36
4,967,913 A 11/1990 Bayer
5,695,073 A * 12/1997 Klein et al. ..... 211/35
5,855,279 A * 1/1999 Klein et al. ..... 211/35
D462,539 S 9/2002 Segall
6,464,087 B1 * 10/2002 Klein et al. ..... 211/35
6,533,127 B1 3/2003 Klein et al.
6,637,603 B2 10/2003 Klein et al.
6,793,080 B2 9/2004 Klein et al.
6,854,919 B2 * 2/2005 Neumann et al. ..... 403/326
2002/0166825 A1 * 11/2002 Klein et al. ..... 211/35
2003/0085188 A1 * 5/2003 Klein et al. ..... 211/118
2004/0035806 A1 * 2/2004 Klein et al. ..... 211/34
2004/0045915 A1 * 3/2004 Klein et al. ..... 211/35

(Continued)

*Primary Examiner*—Darnell M Jayne
*Assistant Examiner*—Devin Barnett
(74) *Attorney, Agent, or Firm*—H. Frederick Rusche; Husch Blackwell Sanders LLP

(57) ABSTRACT

A modular folding shoe rack includes first and second side rails; first and second arms pivotably connected with the side rails at a first end of the arms; a first crossbar connected with the opposite ends of the arms; and a second crossbar connected with the side rails. Each side rail may also include complementary male/female connectors at its opposite ends to allow for connection of one side rail to another, resulting in a modular design.

16 Claims, 12 Drawing Sheets

U.S. PATENT DOCUMENTS

2004/0069726 A1* 4/2004 Marchetta et al. ..... 211/36
2004/0118791 A1* 6/2004 Rimback et al. ..... 211/34
2004/0173553 A1 9/2004 Li
2006/0049121 A1* 3/2006 Klein et al. ..... 211/35
2007/0138113 A1* 6/2007 Haberman ..... 211/35

* cited by examiner

FOLDING SHOE RACK

CROSS-REFERENCE TO RELATED APPLICATIONS

This application claims the priority of provisional application Ser. No. 60/798,930, filed May 9, 2006.

FIELD OF THE INVENTION

The present invention relates to footwear storage and in particular to storage assemblies for mounting on vertical surfaces such as doors.

RELATED ART

Door-mounted shoe racks are a popular item since they represent a relatively simple way to create additional space in a closet or other room. Numerous shoe rack designs have been developed. However, many of these designs suffer from defects such as those listed below.

Many prior art racks have arms that project outwards but do not fold up, requiring the rack to take up a lot of space even when not in use or when in transport. In addition, the crossbars of non-folding racks can interfere with the storage of taller items such as boots. Other racks have a single crossbar at each level, rather than a pair, which limits the types of articles that can be held to those which will hook onto the single crossbar. Still other racks are complicated and expensive to manufacture and are cumbersome to transport. Others are difficult to install and cause damage to the structure onto which the rack is installed, for example requiring drilling of holes and attachment of fasteners. Yet others have a fixed design that does not offer modularity and flexibility in use.

Therefore, it would be advantageous to provide an improved shoe rack that is modular and can be expanded to attach additional racks; is simple to manufacture and assemble; is lightweight yet durable; can hold a variety of articles, and can fold up when not in use or to accommodate larger items.

The present invention is directed to overcoming one or more of the problems set forth above.

SUMMARY OF THE INVENTION

One aspect of the invention generally pertains to an improved shoe rack that is capable of folding to reduce its overall size and to accommodate items of larger or bulkier size.

Another aspect of the invention relates to an improved shoe rack that is modular in nature to allow for ready expansion of the rack.

In one embodiment of the invention, there is provided a modular folding shoe rack that includes first and second side rails, each of the side rails having first and second ends; first and second arms, each of the arms having a first and a second end and wherein the first end of the first arm is pivotably connected with the first side rail and the first end of the second arm is pivotally connected with the second side rail; a first crossbar having first and second ends, the first end of the first crossbar connected with the second end of the first arm and the second end of the first crossbar connected with the second end of the second arm; and a second crossbar having first and second ends, the first end of the second crossbar connected with the first side rails and the second end of the second crossbar connected with the second side rail.

In another embodiment, each side rail may also include complementary male/female connectors at its opposite ends to allow for connection of one side rail to another, resulting in a modular design.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE PREFERRED EMBODIMENTS

Figure 1:
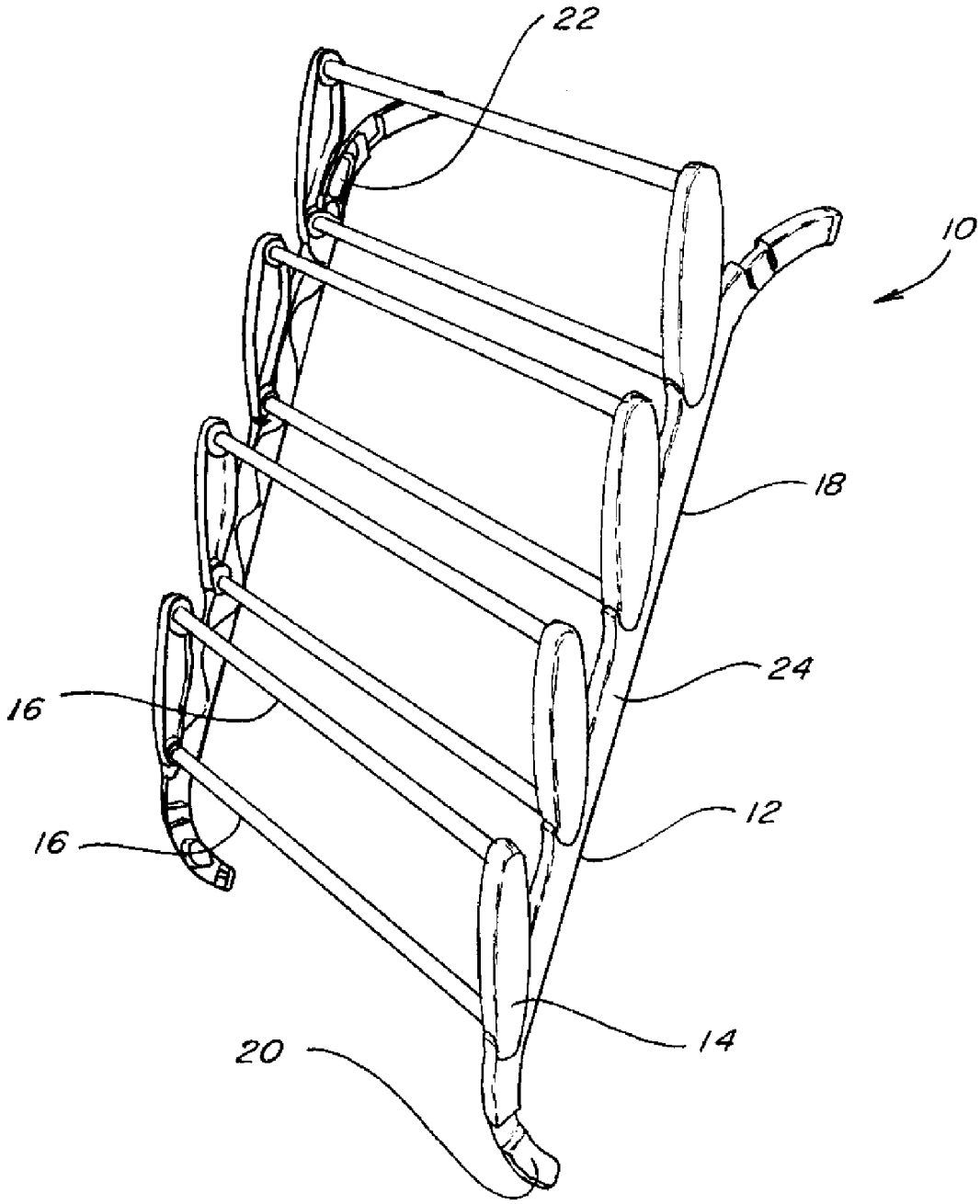
FIG. 1 is a perspective view of a folding shoe rack with its arms folded according to a first embodiment of the present invention.
Figure 2:
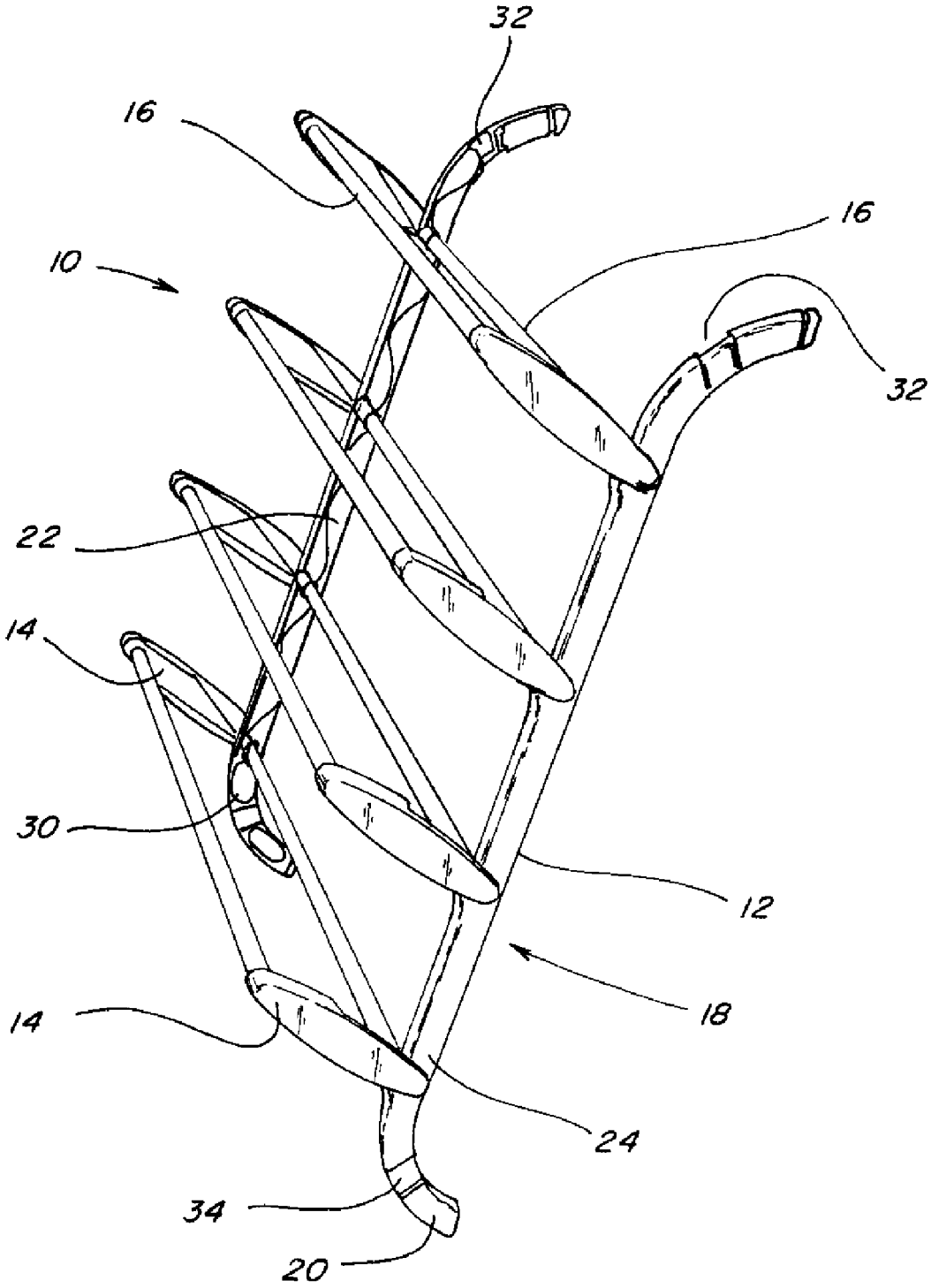
FIG. 2 is a perspective view of the folding shoe rack of FIG. 1 with its arms unfolded.
Figure 3:
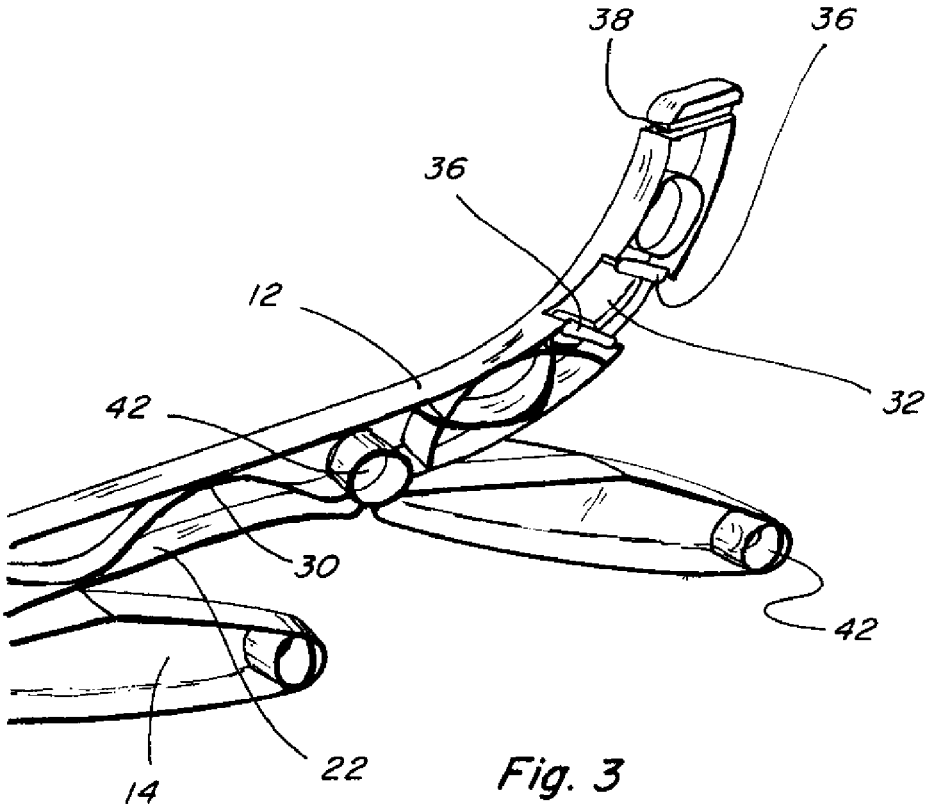
FIG. 3 is a close-up side view of a side rail for a folding shoe rack according to another embodiment.
Figure 4:
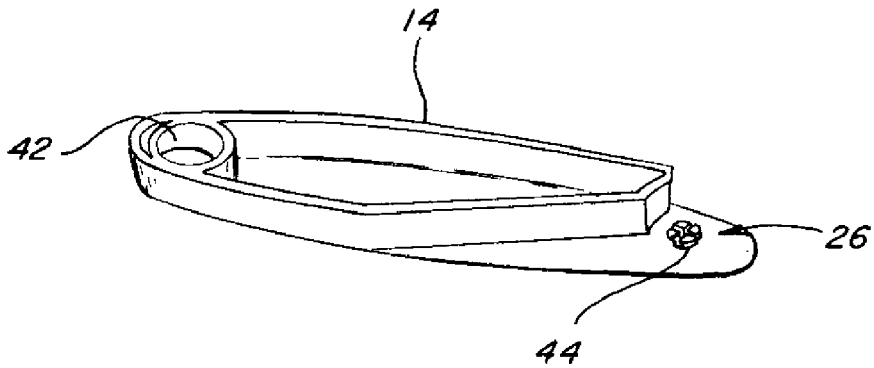
FIG. 4 is a perspective view of an arm for a folding shoe rack according to another embodiment.
Figure 5:
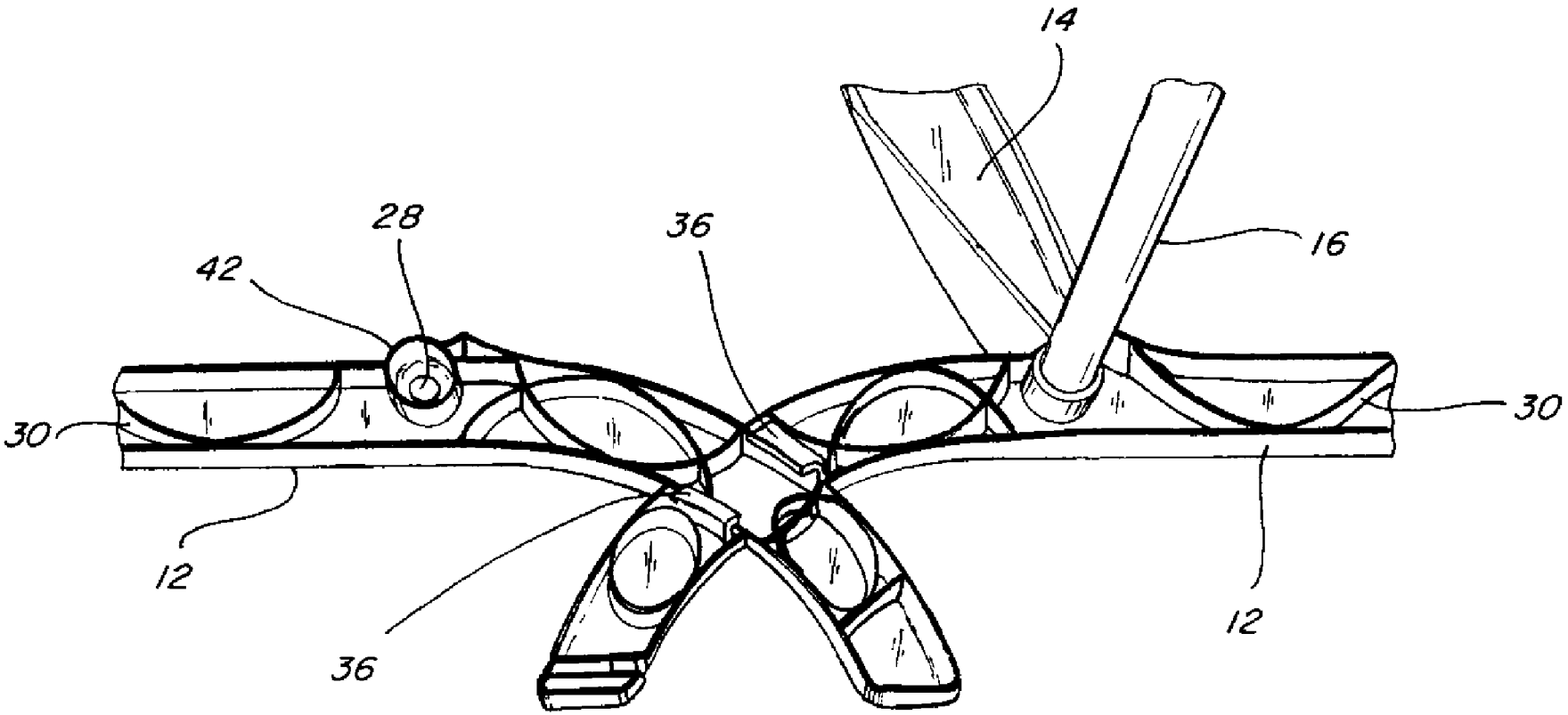
FIG. 5 is a view of the connection of two side rails according to another embodiment.
Figure 6:
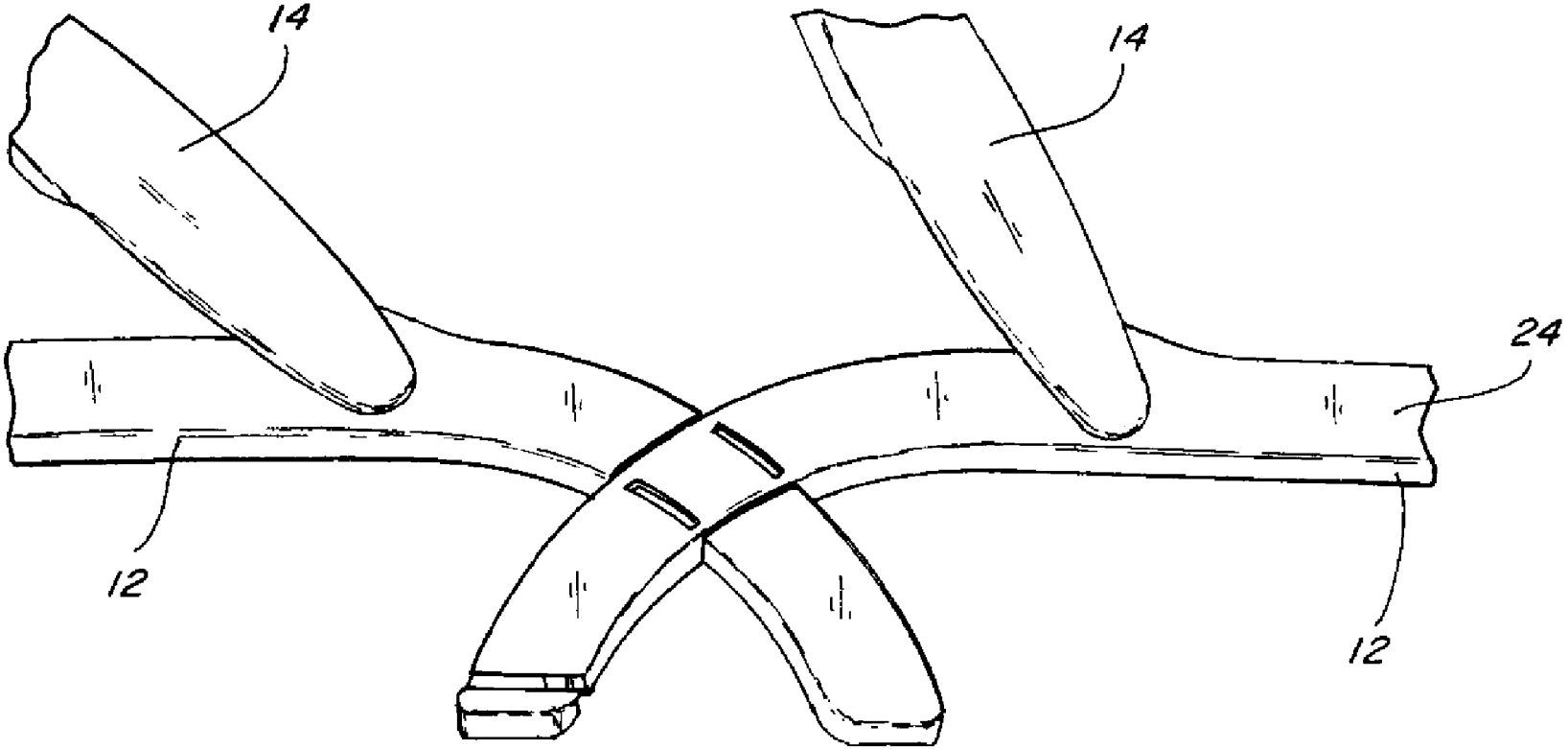
FIG. 6 is a view of the opposite side of the connected side rails of FIG. 5.
Figure 7:
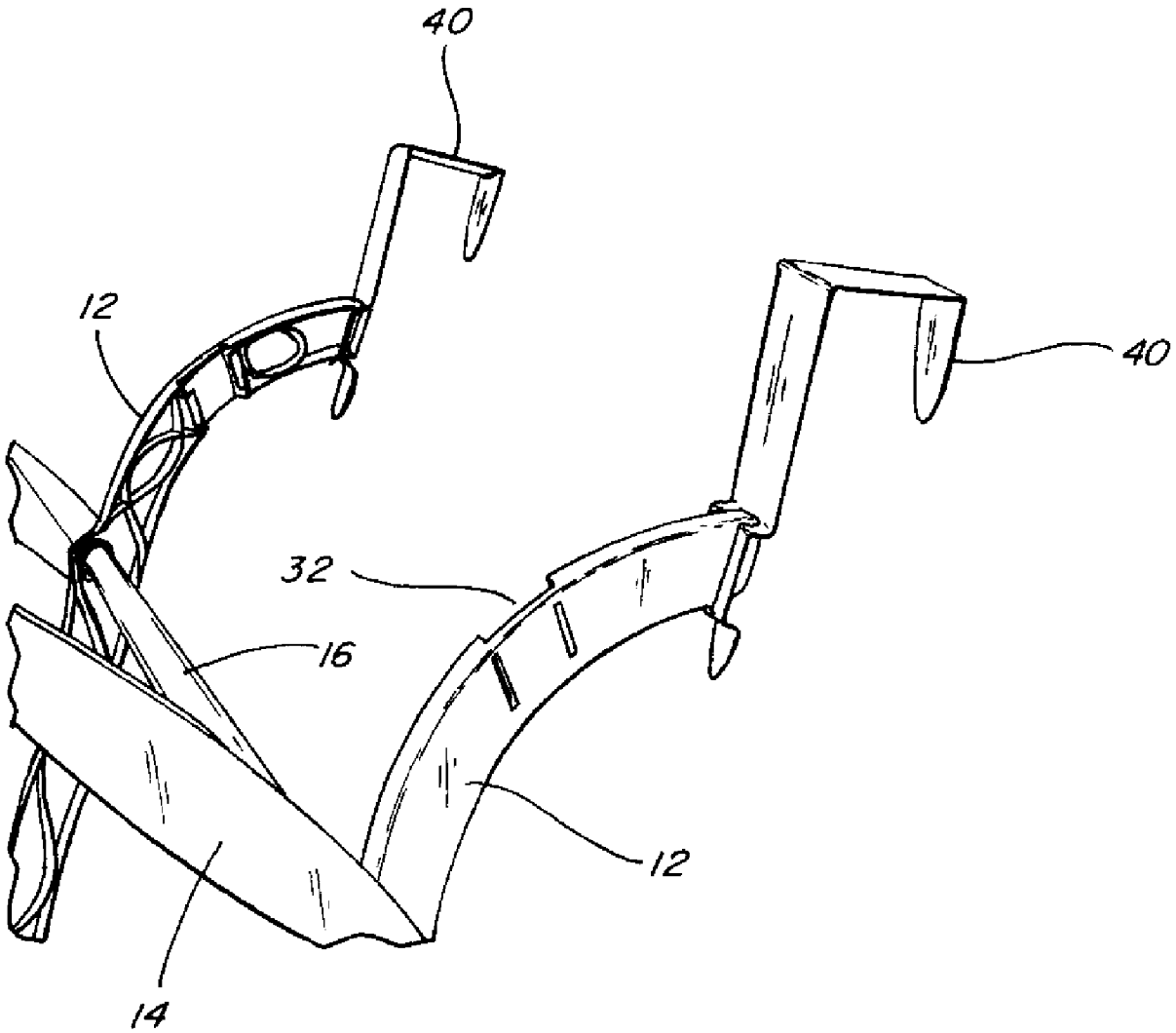
FIG. 7 is a side view of a folding shoe rack with hanging clips according to another embodiment.
Figure 8:
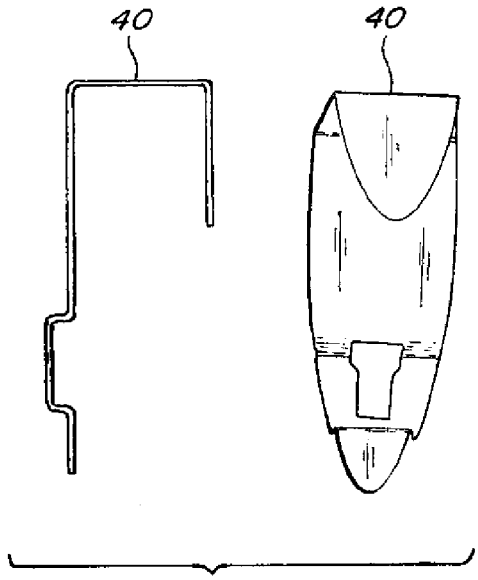
FIG. 8 includes front and side view of a hanging clip for use with a folding shoe rack according to an embodiment.
Figure 9:
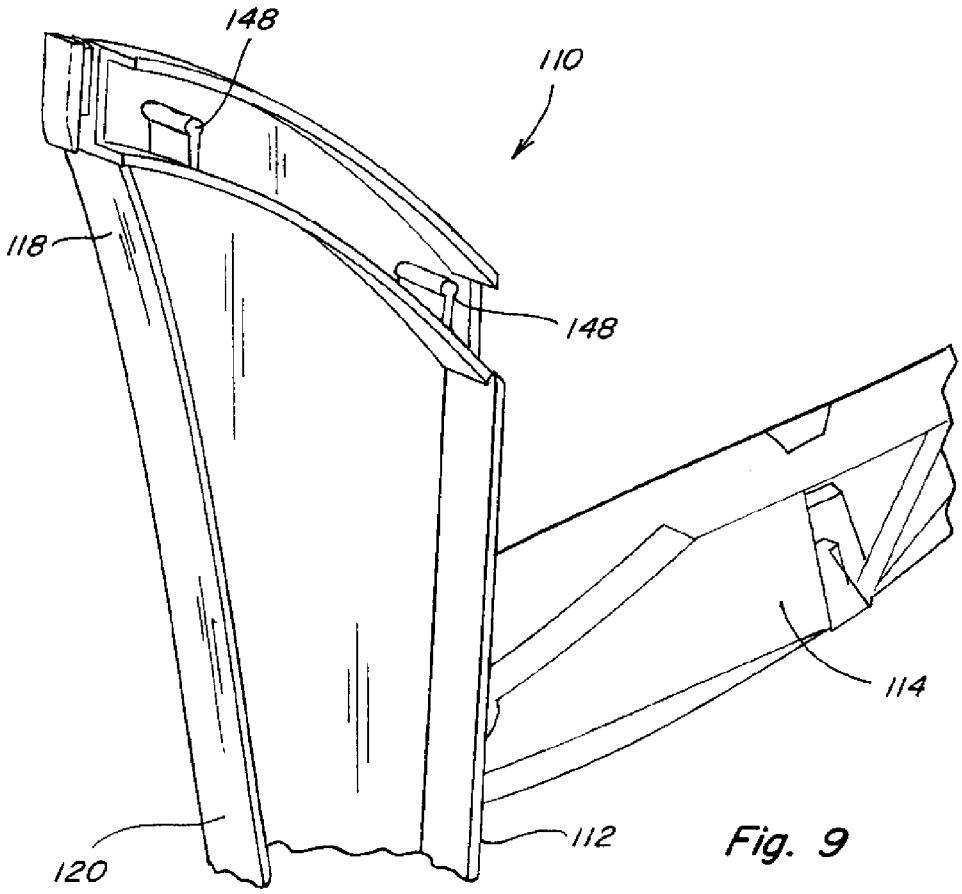
FIG. 9 is a close-up view of the upper end of a side rail for a folding shoe rack according to another embodiment.
Figure 10:
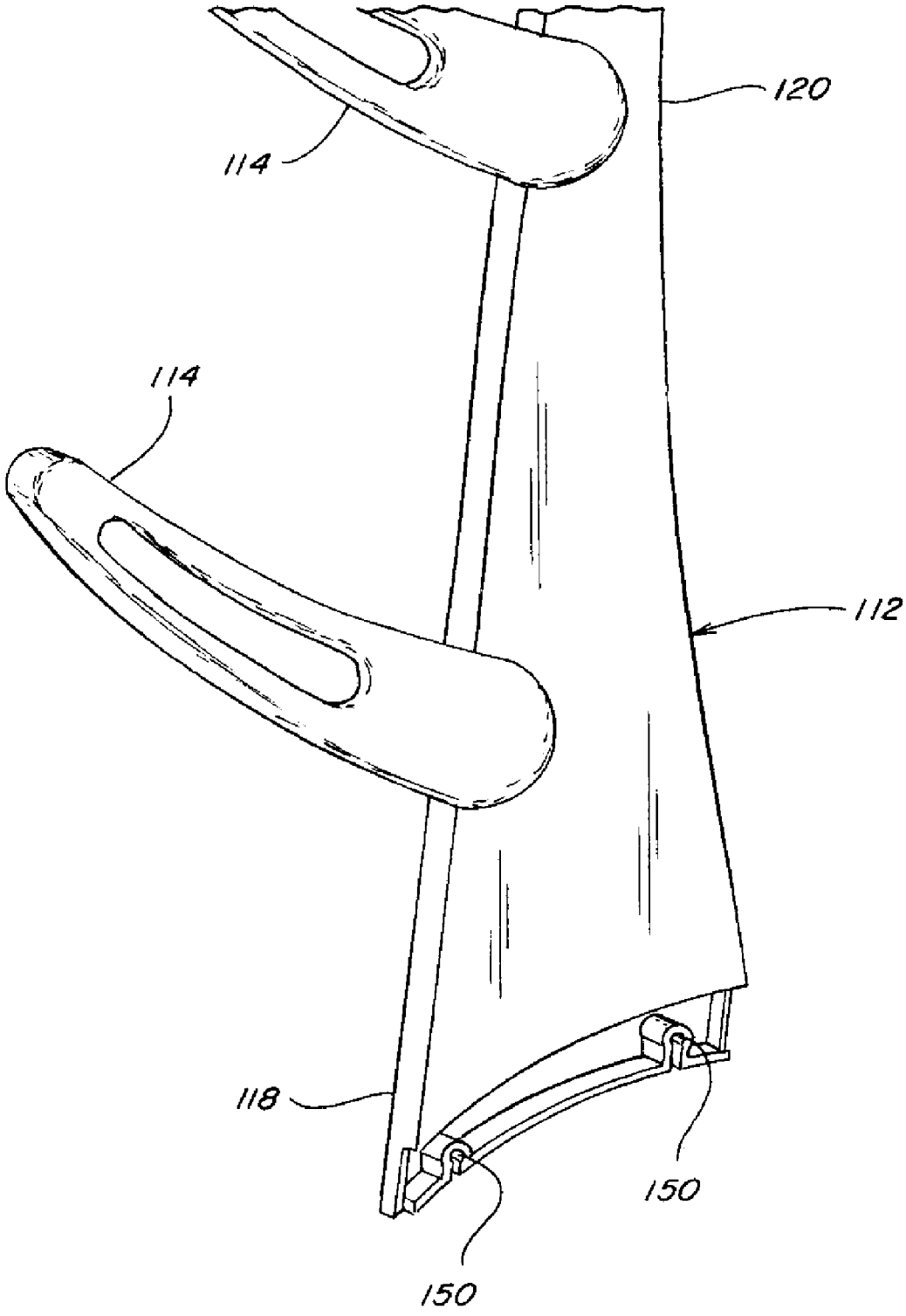
FIG. 10 is a close-up view of the lower end of a side rail for a folding shoe rack.
Figure 11:
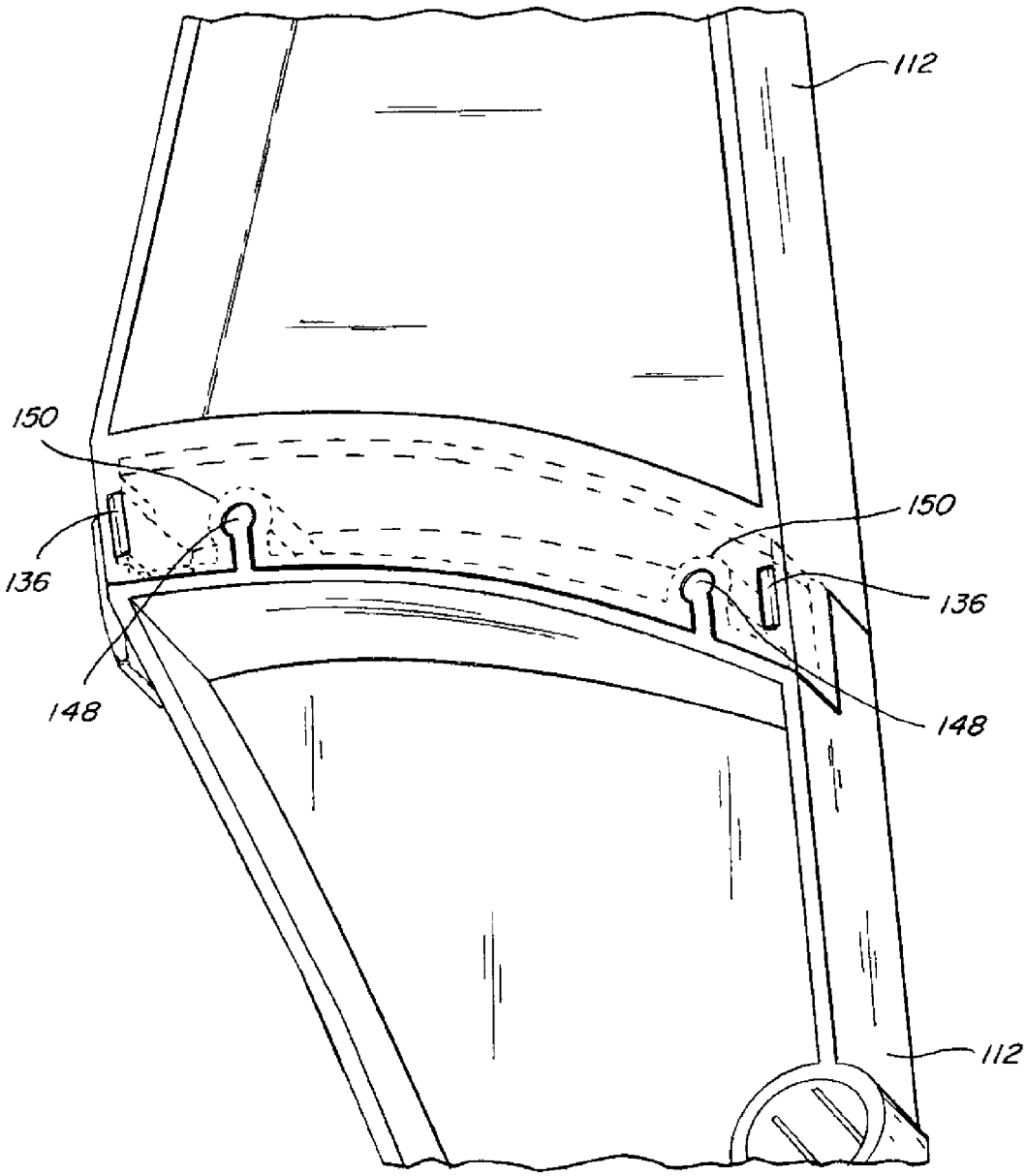
FIG. 11 is a close-up view of the connection between two side rails according to another embodiment.

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention. The following description of the preferred embodiment(s) is merely exemplary in nature and is in no way intended to limit the invention, its application, or uses.

A modular folding shoe rack 10 comprises a pair of side rails 12, at least one pair of folding arms 14, and at least one pair of crossbars 16.

In one embodiment as illustrated in FIGS. 1-8, the side rails 12 comprise a straight portion 18 with a curved portion 20 at each end. The side rails 12 have a medial face 22 and a lateral face 24, wherein the medial face 22 is designed for one of the pair of crossbars 16 to attach thereto. Centered coaxially at the point where the crossbar 16 attaches to the side rail 12 is a hinge point of the folding arm 14. In one embodiment, the folding arm 14 has a pair of tabs or an expansion plug 26 protruding therefrom which snap into a hole 28 in the side rail 12. The curved end portions 20 of the side rails 12 help to hold the straight portion 18, which has the crossbars 16 attached thereto, away from a door or other structure to which the rack 10 is attached. This permits shoes or other items to hang over the crossbars 16 so that they can be properly balanced on the rack 10.

In one embodiment, the side rails 12 are hollow, with the lateral face 24 being solid while the medial face 22 is open. In a preferred embodiment, the side rails 12 contain on the medial side 22 a plurality of reinforcing webs 30, which, in one embodiment curve, from side to side within the rail 12. By having the reinforcing webs 30 curve like this, the webs 30 make contact with all three walls of the hollow side rail 12. The side rails 12 are made in mirror-image pairs for attachment at each end of the crossbar 16.

At each attachment point for a folding arm 14, the side rails 12 have a curved portion for engagement with the complementary curved portion of the folding arms 14 as well as a flat projection for holding the folding arm 14 in place when it is unfolded.

The side rails 12 preferably have an upper 32 and a lower 34 dado molded therein for joining side rails 12 together in a vertical orientation. The dadoes 32, 34 are preferably in the middle of the curved portions 20 of the side rails 12. The upper 32 and lower 34 dadoes are also preferably on opposite faces of the side rails 12 to facilitate attachment of racks to one another. In one embodiment, the upper dado 32 is on the medial face 22 of the side rail 12 and the lower dado 34 is on the lateral face 24. It is also preferred that at least one of the dadoes have a pair of snapping clips or hooked tabs 36 associated therewith to keep the racks snugly attached to one another. In one embodiment, such snapping clips 36 are associated with the upper dado 32 on either side of the dado slot. In a preferred embodiment, the top ends of the side rails 12 have slots 38 molded therein for attachment of a hanging clip 40, for hanging the rack 10 on a door or other structure. The slots 38 in one embodiment comprise a recess in three out of the four sides of the side rail 12, the exception being the top side, and a detent inside the slot for preventing the hanging clip 40 from sliding out.

In one embodiment the receptacle for attachment of the crossbars 16 is a cup 42 molded into the folding arm 14 or the side rail 12 that is complementary to the size and circular cross-section of the crossbars 16. To hold the crossbars 16 more snugly in place there are a plurality of raised ridges molded on the inside walls of the cup 42, the ridges being disposed parallel to the long axis of the crossbars 16. The ridges hold the crossbars 16 firmly in place upon installation, which has the added benefit of preventing the crossbars 16 from rotating, where such rotation could allow the materials to slide off the rack.

The folding arm 14 also comprises a medial side and a lateral side. Pairs of mirror-image folding arms 14 are used for attachment to either end of each crossbar 16 and to permit mounting on a left or right side rail 12. In one embodiment, the folding arm 14 comprises an oval-shaped flat portion that is on the lateral side of the arm, with a wall on the medial side that is perpendicular to the flat portion. The perpendicular wall attached to the flat portion helps make the folding arm 14 more rigid.

The folding arm 14 comprises a proximal end and a distal end. The distal end has molded therein the aforementioned cup 42 for holding the crossbar 16. The proximal end is adapted for hinged attachment to the side rail 12 as further described below. The folding arm 14 in one embodiment has a curved wall portion near its proximal end that is complementary to the outside of the cup 42 that holds the crossbars. This curved wall portion helps to stabilize the folding arm 14 against the side rail 12 while still permitting the folding arm 14 to pivot.

The pair of crossbars 16 comprises an inner crossbar that is attached to the side rails 12 and an outer crossbar that is attached to the distal ends of the folding arms 14. The folding arms 14 hold the outer crossbar at a point that is higher than the inner crossbar, such that the folding arms 14 and the pair of crossbars 16 define a plane that is at an angle relative to the side rails 12. In one embodiment, this plane is at approximately 60 to 65 degrees with respect to the straight portions of the side rails 12. This angle helps keep the shoes and other items from falling off the rack, particularly if the rack is mounted on a moving object such as a door.

In one embodiment, the folding arms 14 have an oval shape when viewed from the lateral side. From the medial side the wall portions follow the oval shape for more than half of the perimeter of the oval, although at the proximal end the oval perimeter wall is interrupted to allow for hinged attachment of the arm 14 to the side rails 12. The wall has the previously-mentioned rounded portion and in addition there is a straight portion that allows the folding arm 14 to fold closer to the side rail 12. Finally there is a flat edge on the wall that meets a complementary stop that is molded into the side rail 12, in order to stably hold the arm 14 when it is in the folded out position.

Projecting from the medial side of the oval-shaped flat portion at the proximal end is a plug or clip 26 for attachment of the folding arm 14 to the side rail 12. The plug or clip 26 in one embodiment includes a pair of finger-like projections 44 with ridges near the ends, such that the projections bend inward as they are fit through a hole and then the ridges allow the projections to snap into place. An alternate description for this structure is that the plug 26 has a slot running therethrough. The clip 26 is circular in cross-section so as to permit the clip to act as a hinge mechanism for the folding arm 14.

The crossbars 16 in one embodiment are made of metal, although other suitably strong materials such as wood or plastic would also work. To prevent materials that are laid on the crossbars from slipping off, in a preferred embodiment the crossbars 16 are given a coating of non-slip material such as paint that contains abrasive (e.g. sand) or a rubber coating. In one embodiment the crossbars 16 are made of metal in order to provide sufficient rigidity while preventing warping or sagging (as could happen with wood or certain plastics) and also providing a good substrate for the non-stick surface.

To enable attachment of the rack to a door or other structure there is also provided a hanging clip 40. The hanging clip 40 in one embodiment is a piece of sheet metal that is folded on one end to fit over a door and on other end to fit into a slot 38 on the top or the extension of the side rails 12. The end for attachment to the side rails 12 also has one or more holes for engagement with the ends of the side rails 12. In one embodiment, one or more of the inner faces of the hanging clip 40 have a soft material affixed thereto in order to prevent damage to the door or other structure on which the clip 40 is hung. In addition the soft material helps to grip the door or other structure to prevent the rack from sliding off. In one embodiment the soft material is a thin sheet of soft plastic and in other embodiments the material is a thin sheet of solid or foam rubber.

In one particular embodiment there are four pairs of crossbars 16 for each set of side rails 12, with one of each pair of crossbars 16 being attached to the side rails 12 by a pair of folding arms 14 as described herein. However, the side rails 12 may be adapted to attach various numbers of pairs of crossbars 16.

In use, multiple racks can be attached together to form a larger rack system. Furthermore the rack(s) can be attached to a door or other object using the hanging clip 40 described above, where the hanging clip 40 is snapped onto the top end of the side rail 12. The racks and clips are assembled and hung onto a door and the folding arms 14 are folded downward into position as needed. When no shoes or other items are placed on the racks, the folding arms 14 can be folded upwards to take up less space. In addition, the folding feature permits larger articles such as boots to be stored on the racks without interference from the crossbars of one or more racks above. The relatively light weight of the folding arms 14 and crossbars, along with the small amount of friction between the folding arms 14 and side rails 12, permits the folding arms 14 to remain in the folded-up position without any need for a device such as a latch or lock to hold the arms up.

In one embodiment the side rails 12 and folding arms 14 are made of relatively rigid plastics whereas the door clips 40 and crossbars 16 may be made of metal.

FIGS. 9-14 illustrate another embodiment of a shoe rack 110 of similar design to the fore described embodiment. The side rails 112 of this embodiment utilize a slightly different shape with wider ends 118 that taper to a narrow center section 120. On the lateral sides of each upper end of the side rails 112, there are two pin-shaped, laterally extending projections 148. The medial sides of each lower end of the side rails 112 are provided with recesses 150 that correspond to the projections 148. Multiple side rails 112 may be connected vertically by mating these projections 148 and recesses 150. At least one of the projections or recesses may also have a pair of snapping clips or hooked tabs 136 associated therewith to keep the racks snugly attached to one another.

Furthermore, those of skill in the art will recognize that alternate arrangements of the projections 148 and recesses 150 with respect to the medial and lateral sides of the side rails 112 are possible while maintaining the enhanced aesthetic qualities of the design.

Figure 12:
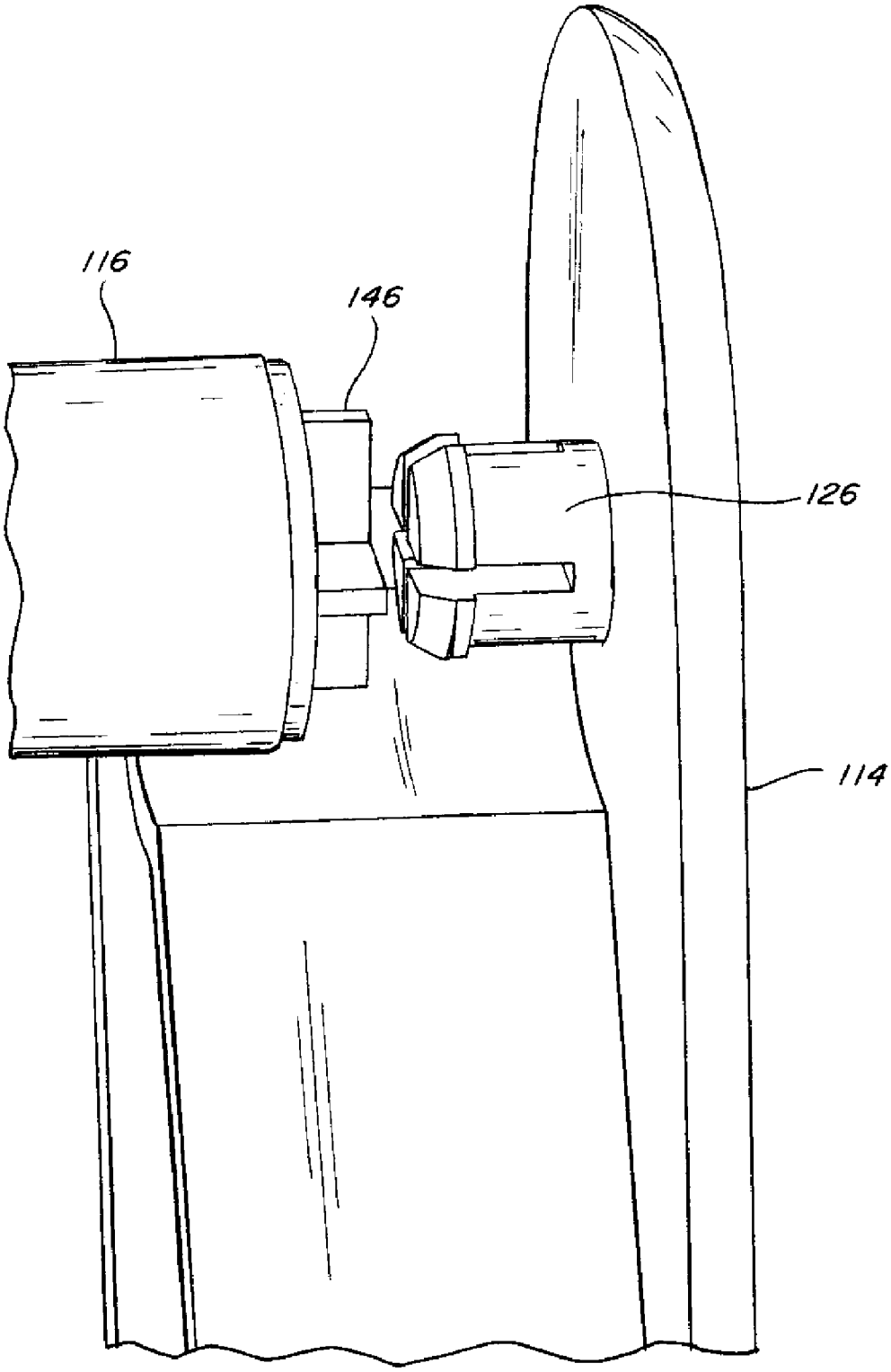
FIG. 12 is an illustration of the connection between a folding arm and crossbar (side rail not shown) in an embodiment of the invention
Figure 13:
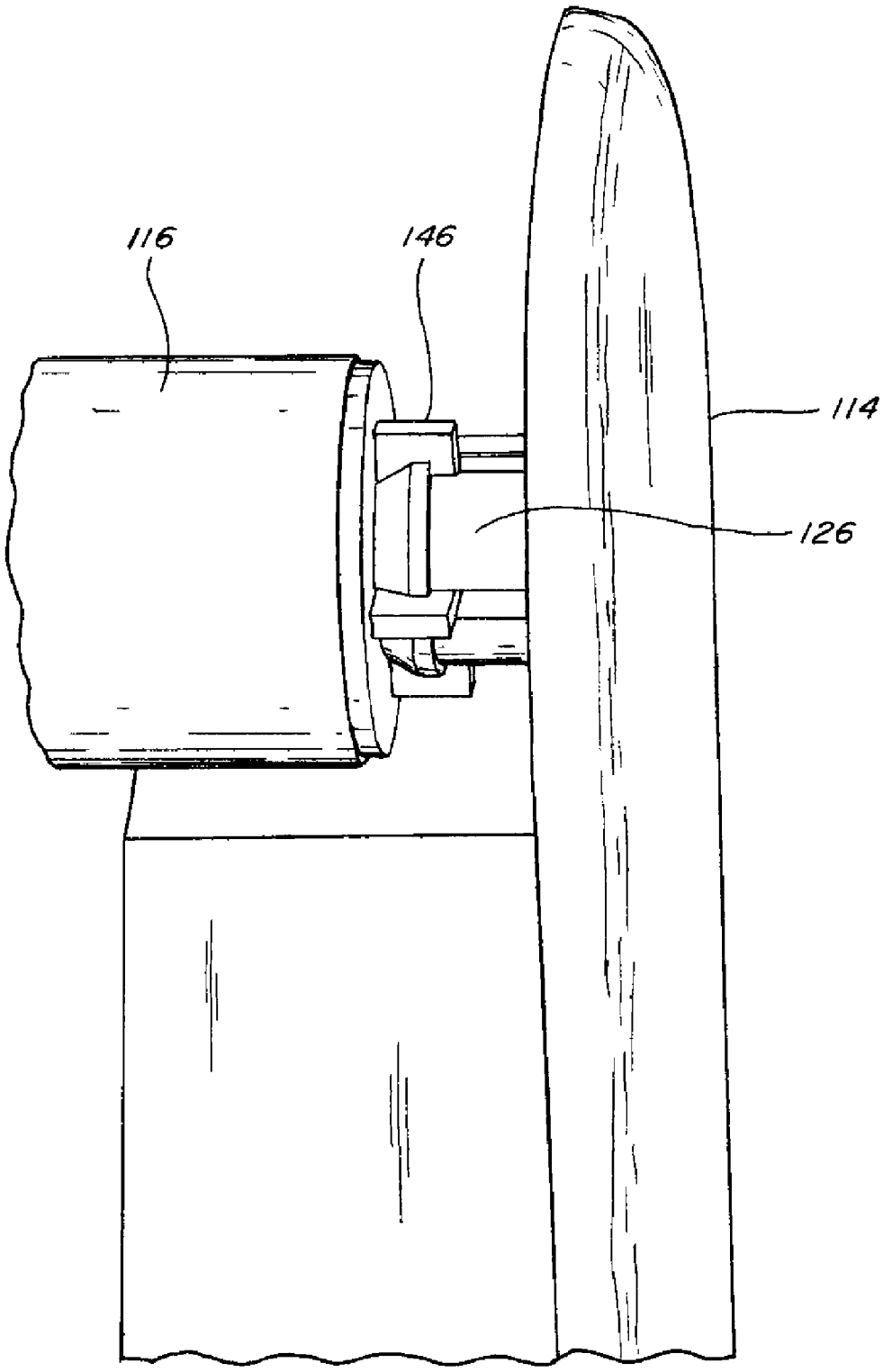
FIG. 13 is another illustration of the folding arm and crossbar of FIG. 13.
Figure 14:
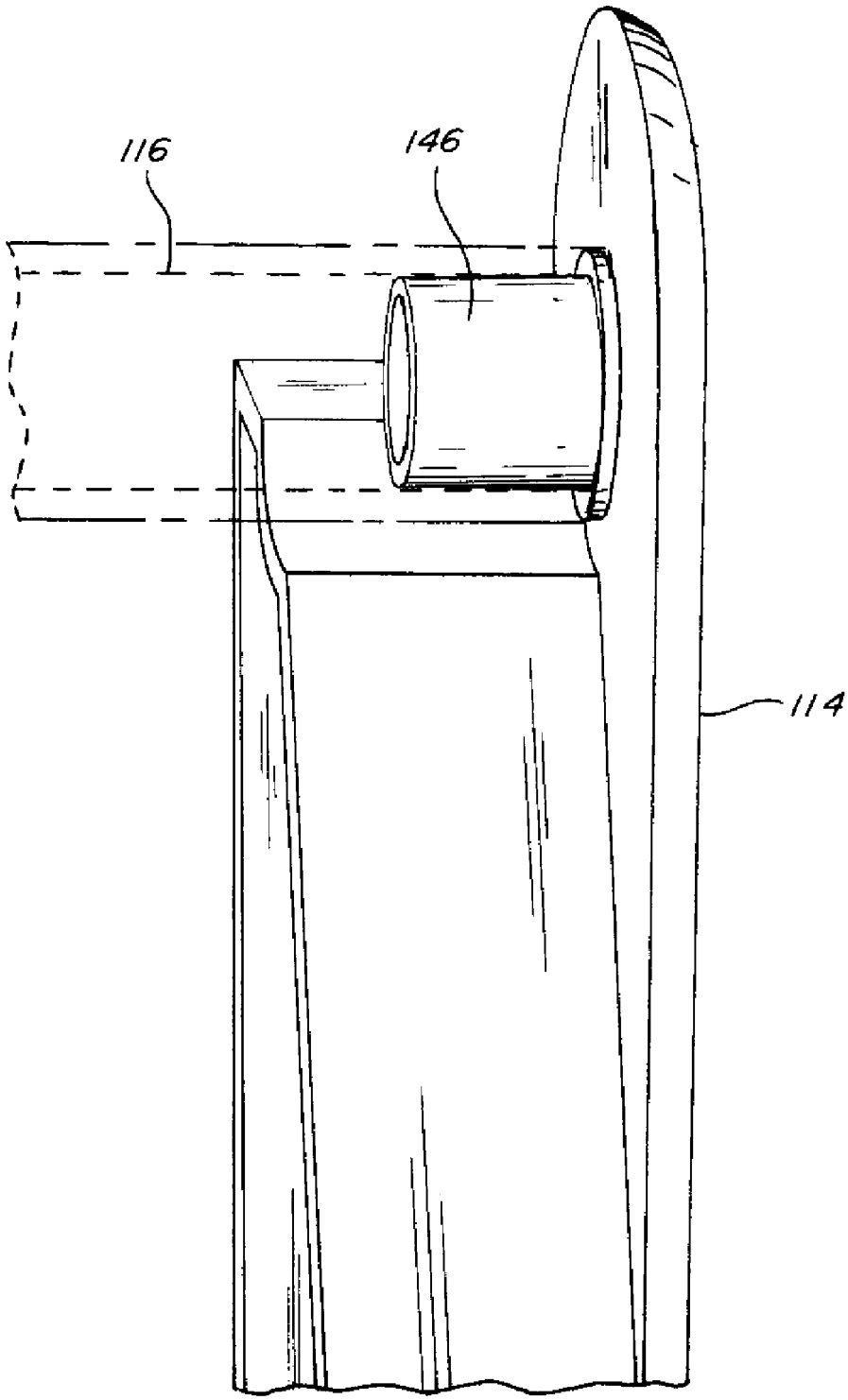
FIG. 14 is an illustration of the connection between a folding arm and crossbar (side rail not shown) in another embodiment.

FIGS. 12-14 also illustrate an alternate embodiment for connecting the folding arms 114 and crossbars 116 to the side rails 112. A plug 126 projects from the medial side of the folding arm 114. The plug 126 includes a ridge near its end and a pair of intersecting slots. The plug 126 is circular in cross-section to serve as a hinge or pivoting mechanism for the folding arm 114. An insert 146 is provided within the end of the crossbar 116. The insert 146 has a cross-sectional shape that corresponds to the intersecting slots of the plug 126, thereby enabling the insert 146 and plug 126 to engage with one another as the plug 126 is inserted through a hole 128 in the side rail 112. This arrangement provides increased integrity and helps prevent disengagement of the folding arm 114 and crossbar 116 from the side rail 112.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A folding shoe rack comprising:

first and second vertical side rails, each of said side rails having first and second ends and medial and lateral sides;

first and second aims, each of said arms having a first and a second end and wherein said first end of said first arm is pivotably connected with said first side rail and said first end of said second arm is pivotally connected with said second side rail;

a first crossbar having first and second ends, said first end of said first crossbar connected with said second end of said first arm and said second end of said first crossbar connected with said second end of said second arm;

wherein said first and second aims and said first crossbar are pivotable between a first position in which said first and second arms and said first crossbar lie generally flush against said first and second side rails and a second position in which said first and second arms are extended away from said first and second side rails, with said first crossbar positioned at a distance from said first and second side rails, to support an article;

a second crossbar having first and second ends, said first end of said second crossbar connected with said first side rail and said second end of said second crossbar connected with said second side rail;

at least one connection projection formed in said medial side of said first end of each of said first and second side rails;

a lateral surface on said lateral side of said first end of each of said first and second side rails, said lateral surface preventing access to said connection projection from said lateral side of said first and second side rails;

at least one connection recess complementary to said connection projection formed in said lateral side of said second end of each of said first and second side rails; and further comprising at least third and fourth side rails, each having a construction essentially identical to said first and second side rails, respectively, and wherein said third side rail is connectable with said first side rail by mating said connection projection and connection recess of said first and third side rails and said fourth side rail is connectable with said second side rail by mating said connection projection and connection recess of said second and fourth side rails.

2. The folding shoe rack as set forth in claim 1, wherein said first end of said second crossbar is connected with said first side rail at said pivotal connection of said first arm and said first side rail and said second end of said second crossbar is connected with said second side rail at said pivotal connection of said second arm and said second side rail.

3. The folding shoe rack as set forth in claim 1, wherein said medial side of said first end of each of said first and second side rails further comprises at least one hooked tab; and wherein said second side of said second end of each of said first and second side rails comprises at least one slot complementary to said hooked tab.

4. The folding shoe rack as set forth in claim 1, further comprising a hanging clip, said hanging clip defining a slot therein, said slot being complementary to each of said first and second side rails.

5. The folding shoe rack as set forth in claim 1, further comprising a hanging clip and wherein one end of said side rails defines a slot formed therein for engagement with said hanging clip.

6. The folding rack as set forth in claim 1, wherein said first end of each of said first and second arms comprises an expansion plug integral thereto, said expansion plug defining at least a first slot therein transverse to a long axis of said expansion plug;

wherein each of said first and second side rails defines at least one hole therethrough; and wherein said first and second arms are pivotably connected with said first and second side rails, respectively, by insertion of said expansion plug into said hole; and wherein said slot permits said expansion plug to be compressed during insertion of said expansion plug into said hole, said expansion plug expanding once fully inserted into said hole to secure said expansion plug within said hole.

7. The folding rack as set forth in claim 6, further comprising inserts within said first and second ends of said second crossbar, said inserts being oriented with their axes aligned with the axis of the second crossbar and adapted for engagement with said expansion plugs of said first and second arms.

8. The folding rack as set forth in claim 7, wherein said expansion plug defines intersecting slots therein and said inserts having a cross-sectional shape complementary to said intersecting slots.

9. A folding shoe rack, comprising:

first and second side rails comprising a vertical, straight portion having a curved upper end and a curved lower end, said side rails having a medial side and a lateral side;

at least one pair of folding arms having a proximal end and a distal end, wherein said proximal ends of said folding arms are pivotably attached to said straight portion of said side rails; and at least one pair of crossbars, comprising an inner crossbar and an outer crossbar, wherein said outer crossbar is attached to said distal ends of said at least one pair of folding arms and said inner crossbar is attached to said medial sides of said side rails such that said folding arms pivot about said inner crossbar;

wherein said folding arms and said outer crossbar are pivotable between a first position in which said folding arms and said outer crossbar lie generally flush against said side rails and a second position in which said folding arms are pivoted away from said side rails, with said outer crossbar positioned at a distance from said first and second side rails, to support an article;

said first and second side rails each having first and second ends;

a male connection formed in said medial side of said first end of each of said first and second side rails;

a lateral surface on said lateral side of said first end of each of said first and second side rails, said lateral surface preventing access to said male connection from said lateral side of said first and second side rails; and a female connection complementary to said male connection formed in said lateral side of said second end of each of said first and second side rails.

10. The folding shoe rack as set forth in claim 9, wherein said male connection comprises at least one connection projection and said female connection comprises at least one connection recess complementary to said connection projection.

11. The folding shoe rack as set forth in claim 9, wherein said male connection further comprises at least one hooked tab and said female connection comprises at least one slot complementary to said hooked tab.

12. The folding shoe rack as set forth claim 9, wherein said male connection comprises a first dado slot and said female connection comprises a second dado slot complementary to said first dado slot.

13. The folding shoe rack as set forth in claim 12, wherein said first dado slot has a pair of hooked tabs adjacent thereto for engagement of said side rail with a complementary dado slot.

14. The folding shoe rack as set forth in claim 9, wherein one end of said side rails comprises an extension and further comprising a hanging clip, said hanging clip defining a slot therein, said slot being complementary to said extension.

15. The folding shoe rack as set forth in claim 9, further comprising a hanging clip and wherein one end of said side rails defines a slot formed therein for engagement with said hanging clip.

16. A folding shoe rack comprising:

first and second vertical side rails, each of said side rails having first and second ends and medial and lateral sides;

first and second arms, each of said arms having a first and a second end and wherein said first end of said first arm is pivotably connected with said first side rail and said first end of said second arm is pivotally connected with said second side rail;

a first crossbar having first and second ends, said first end of said first crossbar connected with said second end of said first arm and said second end of said first crossbar connected with said second end of said second arm;

wherein said first and second arms and said first crossbar are pivotable between a first position in which said first and second arms and said first crossbar lie generally flush against said first and second side rails and a second position in which said first and second arms are extended away from said first and second side rails, with said first crossbar positioned at a distance from said first and second side rails, to support an article;

a second crossbar having first and second ends, said first end of said second crossbar connected with said first side rail and said second end of said second crossbar connected with said second side rail at least one connection projection formed in said lateral side of said first end of each of said first and second side rails;

at least one connection recess complementary to said connection projection formed in said medial side of said second end of each of said first and second side rails;

a lateral surface on said lateral side of said first end of each of said first and second side rails, said lateral surface preventing access to said connection recess from said lateral side of said first and second side rails; and further comprising at least third and fourth side rails, each having a construction essentially identical to said first and second side rails, respectively, and wherein said third side rail is connectable with said first side rail by mating said connection projection and connection recess of said first and third side rails and said fourth side rail is connectable with said second side rail by mating said connection projection and connection recess of said second and fourth side rails.

* * * * *